United States Patent [19]

Kehl

[11] Patent Number: 4,593,615

[45] Date of Patent: Jun. 10, 1986

[54] WASTE COMPACTOR APPARATUS

[76] Inventor: Charles W. Kehl, 11466 Irvington, Warren, Mich. 48093

[21] Appl. No.: 621,500

[22] Filed: Jun. 18, 1984

[51] Int. Cl.[4] ..... B30B 15/06

[52] U.S. Cl. ..... 100/227; 100/229 A; 100/245; 100/295; 220/1 T; 220/337

[58] Field of Search ..... 100/226, 295, 227, 228, 100/245, 229 A; 220/1 T, 337, 338; 141/73, 71, 80; 53/527

[56] References Cited

U.S. PATENT DOCUMENTS

| | | | |
|---|---|---|---|
| 3,585,781 | 6/1971 | Blee | 141/73 X |
| 3,760,718 | 9/1973 | Adornetto . | |
| 4,331,074 | 5/1982 | Behman | 100/227 X |
| 4,416,197 | 11/1983 | Kehl | 100/245 X |

FOREIGN PATENT DOCUMENTS

| | | |
|---|---|---|
| WO82/01508 | 5/1982 | PCT Int'l Appl. . |
| 2038619 | 7/1980 | United Kingdom . |
| 1598482 | 9/1981 | United Kingdom . |

*Primary Examiner*—Billy J. Wilhite

*Attorney, Agent, or Firm*—Harness, Dickey & Pierce

[57] ABSTRACT

An improved trash receptacle is provided according to this invention. This invention is particularly directed to trash containers of the type having a top assembly which attaches to the open perimeter of a container wherein the top assembly pivotably mounts a swinging door which permits access to the interior cavity of the container. The improvement comprises the addition of releasable pivot means permitting the door to be released from its pivotable engagement with the top frame such that the top can be pushed downwardly into the interior cavity of the container by the user, thereby compacting trash material therein. Once the user has completed the compaction step, the door is re-engageable with the top frame.

20 Claims, 7 Drawing Figures

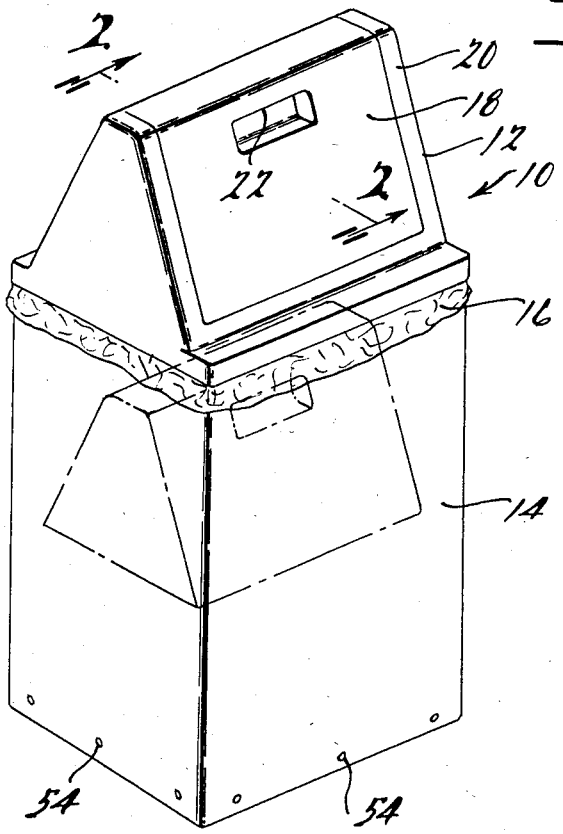
FIG. 1.
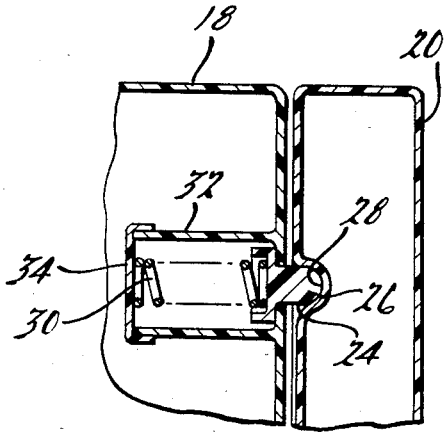
FIG. 3.
FIG. 2.
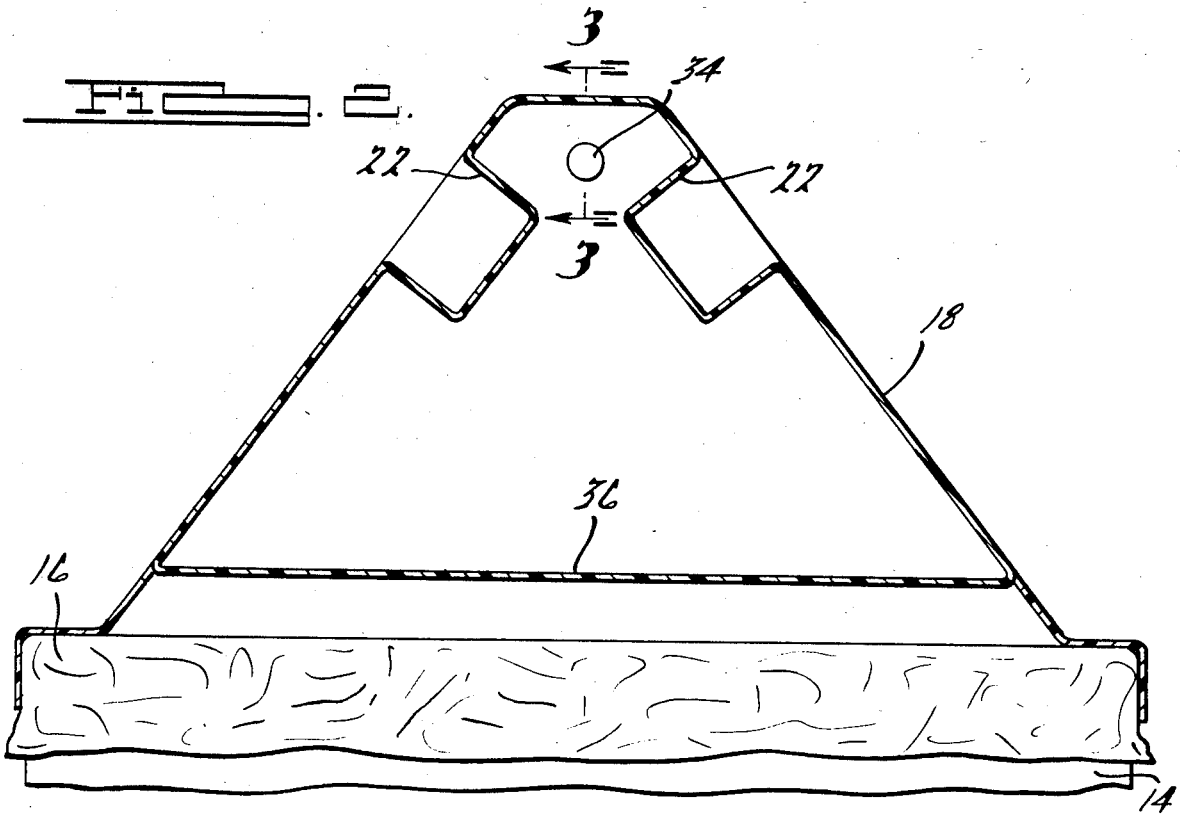

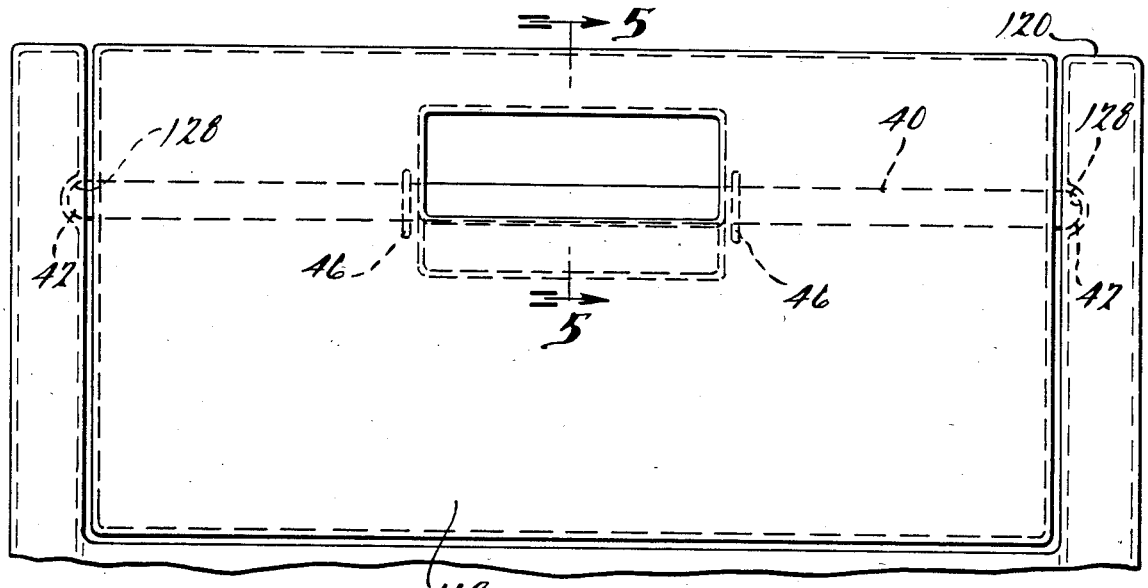
FIG. 4.
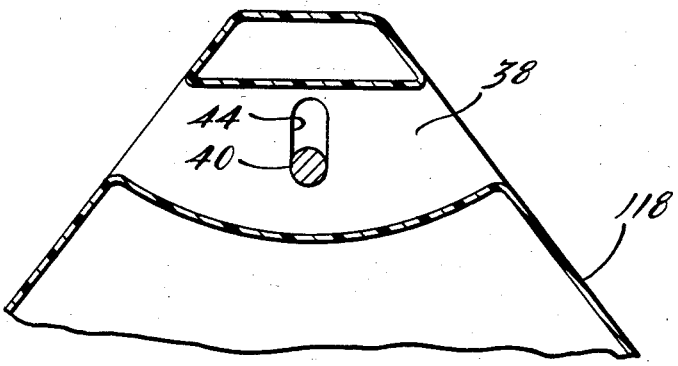
FIG. 5.
FIG. 7.
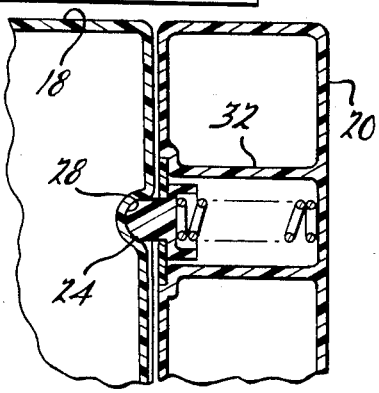
FIG. 6.
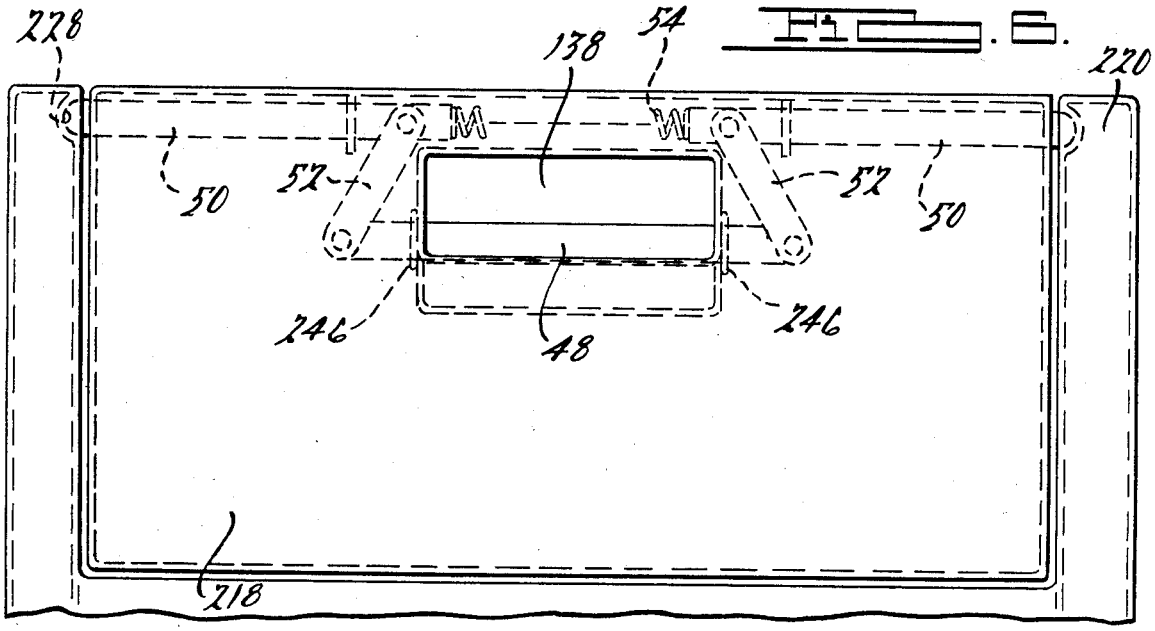

WASTE COMPACTOR APPARATUS

BACKGROUND AND SUMMARY OF THE INVENTION

This invention relates to a waste receptacle and particularly, to one having an integral manually operated compacting mechanism associated therewith.

Trash receptacles are found in all facets of life, including commercial and residential settings. Typically, refuse material is deposited directly into the plastic bag or into a rigid container which may be lined with a plastic trash bag. Most refuse material is low in density, for example, paper and cardboard products and food waste products. Once the trash container or bag is filled, it is normally bundled and transported for disposal. Trash compacting devices are ordinarily not readily accessible and therefore trash normally occupies a much greater volume than would otherwise be necessary. As a result, when using plastic trash bags, a much greater number of these relatively expensive products must be used than is necessary in terms of the weight carrying capacity of the trash bags. Trash receptacles, whether lined or unlined, must be emptied much more frequently than would be necessary if the trash were to be compacted while it is in the container. In order to overcome these problems, many homeowners and others using trash receptacles will attempt to compress the trash using a hand or foot. Another approach often used is to attempt to squeeze the material within a plastic trash bag. These methods are largely ineffective and have other obvious shortcomings. Further, when sharp implements such as empty cans, lids, etc. are within a plastic trash bag, attempts to compact the material within the bag often results in perforation of the plastic bag.

Devices for waste compaction are known according to the prior art. These devices, however, are generally electrically or hydraulically actuated machines which are quite expensive and are not suitable for installation in association with every trash receptacle now in use.

The shortcomings of waste disposal described above are obviated by a trash compactor apparatus according to this invention. This invention is an improvement of existing trash receptacles of the type having a lower container and a top assembly with a pivotable door having a pair of sloping sides. According to this invention, the pivoting door assembly is demountable from the top frame such that it can be forced downward into the trash container to compress the material therein. Thereafter, it is simply brought upwardly into its original engaged position with the top frame. This invention requires minimal changes to existing trash receptacle designs and effectively compresses trash material without the expense and complexity of power operated equipment. By enabling more material to be placed within a plastic trash can liner, a savings in terms of a reduction in the number of bags used is realized. Further, by increasing the density of the waste material, less space is needed to store the trash bags prior to the time when they are removed for disposal. Additionally, the material within a plastic trash bag can be compressed without danger of perforation when the bag lines the relatively rigid trash container. Several embodiments of this invention are described which disclose different means for releasing the pivoting door of the trash receptacle, enabling the door to be used to compress material within the container and thereafter brought back into its original pivoting position.

In a previous patent application filed by this inventor which resulted in issued U.S. Pat. No. 4,416,197 which is hereby incorporated by reference, I describe another means for providing a manually operated trash compactor. That invention, however, related to trash receptacles having a generally flat or convex lid structure. By contrast, this invention relates to an improvement for trash receptacles having a pivotable door.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 1 is a pictorial view of a waste compactor apparatus according to a first embodiment of this invention further showing the door in a displaced trash compacting position within the trash container;

FIG. 2 is a cross-sectional view taken along lines 2—2 of FIG. 1 showing particularly the recessed handles of the door according to the first embodiment of this invention;

FIG. 3 is a cross-sectional view taken along lines 3—3 of FIG. 2 showing in detail a releasable pivot pin of the first embodiment of this invention;

FIG. 4 is a frontal view of a door according to a second embodiment of this invention;

FIG. 5 is a cross-sectional view taken along lines 5—5 of FIG. 4 particularly showing the mounting of the door releasing bar within the hand access opening; and FIG. 6 illustrates a third embodiment for this invention employing another means for releasing the lid from the remainder of the trash receptacle housing.

FIG. 7 is a cross-sectional view like FIG. 3 but showing an orientation of the components reversed from the orientation shown in FIG. 3.

DETAILED DESCRIPTION OF THE INVENTION

A trash compactor apparatus according to this invention is generally shown by FIG. 1 and is designated there by reference character 10. Waste compactor apparatus 10 includes top assembly 12 which is placed in registry with the exterior perimeter of container 14. A plastic bag 16 may be inserted within the interior cavity of container 14 and is held firmly in position there by clamping engagement between top assembly 12 and container 14. Top assembly 12 is made from two major components. Door 18 is pivotably attached to top frame 20 such that material can be inserted within the opening formed below door 18 by simply pushing the door from either side, causing it to pivot with respect to top frame 20. Door 18 is characterized as having a pair of generally planar surfaces inclined with respect to one another such that they are connected along an apex.

In accordance with prior art trash container designs, door 18 is attached to top frame 20 permanently such that it cannot be conveniently dismounted from top frame 20. However, in accordance with this invention, door 18 is easily and conveniently released from its pivotal engagement with top frame 20 enabling it to be forced downwardly into contact with refuse within container 14 as shown in phantom lines by FIG. 1 thereby compressing the refuse. The user merely exerts a downward force while grasping door 18 to compress the trash material. The provision of a removable door 18 further enables the user to remove it for cleaning and for insertion of large objects within container 14. In order to permit air which is trapped between plastic bag 16 and container 14 to escape while trash is compacted, the container is formed with a plurality of small holes 54. These holes further facilitate bag 16 removal by preventing an "air lock" to exist in the lower portion of container 14. As is known to those skilled in the art, bag removal can be facilitated by incorporating a foot support such as an indentation or outwardly extending flange which the user steps on while removing the bag, thereby restraining the container.

In accordance with the first embodiment of this invention, door 18 is provided with one or a pair of opposing recessed channels 22 which enable convenient grasping by the user. Door 18 is further provided with a pair of opposing spring-loaded pivot pins 24 at one or both ends of the door. As best shown by FIG. 3, pivot pin 24 has a rounded protruding end 26 which engages with depression 28 formed by top frame 20. Pivot pin 24 is biased outwardly by spring 30 which is contained within cylinder 32 and is trapped within the cylinder by end cap 34. Depression 28 of top frame 20 has a radiused outer edge enabling pivot pin 24 to be depressed within cylinder 32 when the user desires to disengage door 18 from top frame 20. When either an upward or downward force is exerted on door 18, the radiuses of depression 28 cooperate with the rounded protruding end 26 of pin 24 causing the pin to be depressed and enabling the door to be disengaged. As an additional feature, top frame 26 may be provided with a guide surface which will gradually cause depression of pivot pin 24 within cylinder 32 when the door is brought upward from its position of compressing refuse within the container into engagement with top frame 20. As an alternative to the structure described above, cylinder 32 and pivot pin 24 could be installed within top frame 20 whereas depression 28 could be formed by door 18.

Door 18 may also be provided with a lower, generally planar wall 36 which provides a two-fold function. Wall 36 first acts to exert a distributed load over the trash material within container 14 when door 18 is depressed within the container. Further, wall 36 acts as a reinforcement to prevent failure of the door as it is pressed downwardly against the material within container 14.

FIGS. 4 and 5 illustrate a second embodiment according to this invention. For this embodiment, door 118 forms a channel for grasping by a user's hand which passes completely through the door, thereby communicating both surfaces of the door. Channel 38 is best shown with reference to FIG. 5. As with the first embodiment, means are provided for enabling door 118 to be easily removed from its pivotable engagement with top frame 120. An elongated deflectable pivot rod 40 is provided which passes through channel 38 and has a pair of ends 42. When it is desired to remove door 118 from top frame 120, the user simply inserts his or her hand within channel 38 and lifts pivot rod 40 upwardly. As pivot rod 40 deflects, its ends 42 are drawn together until they are no longer engaging with depressions 128. As an alternative, depression 128 could be replaced by other receiving means, such as a bore. As shown by FIG. 5, the deflecting motion of pivot rod 40 is guided by providing one or more slots 44 within the end surfaces forming channel 38. Additionally, the axial position of pivot rod 40 may be controlled by providing radially protruding flanges 46 shown by FIG. 4. Flanges 46 ensure that both ends 42 are withdrawn as rod 40 is deflected. These flanges may be formed integrally with rod 48 or may take the form of separate washer-like components attached to the rod.

In operation, the user merely lifts on pivot rod 40, causing a release of door 118. Compression of the trash proceeds exactly as described in connection with the first embodiment. When it is desired to re-engage door 118 with top frame 120, pivot rod 40 is again deflected and the components are repositioned and are caused to re-engage when the user releases pressure on pivot rod 40.

FIG. 6 illustrates a third embodiment according to this invention. This embodiment provides another means for releasable engagement between door 218 and top frame 220. For this embodiment, channel 138 is provided with actuating rod 48 disposed therein. Actuating rod 48 is disposed within slots 144 such that it is movable between upper and lower positions within channel 138. Movement of actuating rod 48 causes axial contraction of a pair of elongated pivot pins 50. Such motion is achieved by providing a pair of links 52 connected to the ends of actuating rod 48 and pivot rod 50. Spring 54 is provided which biases pivot rods 50 apart such that they are normally in a position to engage depressions 228 within top frame 220. Pivot rods 50 are mounted so that they are constrained to purely axial motion. As with the second embodiment, a pair of flanges 246 are provided which control the axial positioning of pivot rods 50 and to ensure that both are withdrawn when actuating rod 48 is moved.

As a means of preventing unauthorized removal of the trash container door, locking means can be provided which require a key or knowledge of a combination or method in order to release the door.

While the above description constitutes the preferred embodiments of the present invention, it will be appreciated that the invention is susceptible to modification, variation and change without departing from the proper scope and fair meaning of the accompanying claims.

What is claimed is:

1. In a trash receptacle, an improved top assembly of the type having a frame attachable to the opened perimeter of a container, said top assembly pivotably mounting a door, wherein the improvement comprises;

handle means formed by said door and, at least one releasable pivot means enabling said door to be released from pivotable engagement with said frame, such that said door may be pushed within said container thereby compressing waste material within said container, and said door thereafter being reengageable with said frame.

2. The improved top assembly according to claim 1 wherein said releasable pivot means comprises a pivot pin resiliently biased within a depression formed by said frame.

3. The improved top assembly according to claim 1 wherein said releasable pivot means comprises a pivot pin resiliently biased within a depression formed by said door.

4. The improved top assembly according to claim 2 wherein said pivot pin is resiliently biased by a compressed spring affixed to said door.

5. The improved top assembly according to claim 3 wherein said pivot pin is resiliently biased by a compressed spring affixed to said frame.

6. The improved top assembly according to claim 5 wherein said pivot pin has a rounded end.

7. The improved top assembly according to claim 1 wherein said releasable pivot means comprises a resilient pivot rod having ends engaging depressions formed by said frame, said resilient rod passing within said handle means whereby said resilient rod is deflectable by a user grasping said handle means.

8. The improved top assembly according to claim 1 wherein said releasable pivot means comprises an actuating rod within said handle means, said actuating rod connected to a pair of pivot rods by links, and biasing means urging said pivot rods apart, whereby movement of said actuating rod causes said pivot rods to move toward one another and out of engagement with depressions formed by said frame.

9. In a trash receptacle, an improved top assembly of the type having a frame attached to the opened perimeter of a container, said top assembly pivotably mounting a door having a pair of surfaces inclined with respect to each other, the improvement comprising;

handle means formed by said door and, at least one releasable pivot means enabling said door to be released from pivotable engagement with said frame, such that said door may be pushed within said container thereby compressing waste material within said container, and said door thereafter being reengageable with said frame.

10. The improved top assembly according to claim 9 further comprising;

said door further forming a wall connected to said door surfaces, said wall contacting said waste material during compaction thereof.

11. The improved top assembly according to claim 9 wherein said handle means comprises a depression formed by one of said door surfaces.

12. The improved top assembly according to claim 9 wherein said handle means comprises a channel through said door.

13. The improved top assembly according to claim 9 wherein said releasable pivot means comprises a pivot pin resiliently biased within a depression formed by said frame.

14. The improved top assembly according to claim 9 wherein said releasable pivot means comprises a pivot pin resiliently biased within depressions formed by said door.

15. The improved top assembly according to claim 13 wherein said pivot pin is resiliently biased by a compressed spring affixed to said door.

16. The improved top assembly according to claim 14 wherein said pivot pin is resiliently biased by a compressed spring affixed to said frame.

17. The improved top assembly according to claim 13 wherein said pivot pin has a rounded end.

18. The improved top assembly according to claim 9 wherein said releasable pivot means comprises a resilient pivot rod having ends engaging depressions formed by said frame, said resilient rod passing within said handle means whereby said resilient rod is deflectable by a user grasping said handle means.

19. The improved top assembly according to claim 9 wherein said releasable pivot means comprises an actuating rod within said handle means, said actuating rod connected to a pair of pivot rods by links, and biasing means urging said pivot rods apart, whereby movement of said actuating rod causes said pivot rods to move toward one another and out of engagement with depressions formed by said frame.

20. A trash receptacle comprising;

a container having an upper opened end, said container further having vent holes in the lower portion thereof, a top having a frame attachable to said container upper opened end, and a door having a pair of surfaces inclined with respect to each other, said door releasably pivotably connected to said frame such that said door may be pushed within said container, said door thereafter being reengageable with said frame.

* * * * *